US007713175B2

(12) United States Patent
Monaghan

(10) Patent No.: US 7,713,175 B2
(45) Date of Patent: May 11, 2010

(54) INFANT ACTIVITY SYSTEMS

(76) Inventor: Michael J. Monaghan, 4461 N. Launfal Ave., Phoenix, AZ (US) 85018

( * ) Notice: Subject to any disclaimer, the term of this patent is extended or adjusted under 35 U.S.C. 154(b) by 0 days.

(21) Appl. No.: 11/278,657

(22) Filed: Apr. 4, 2006

(65) Prior Publication Data

US 2006/0226615 A1 Oct. 12, 2006

Related U.S. Application Data

(60) Provisional application No. 60/713,286, filed on Aug. 31, 2005, provisional application No. 60/669,540, filed on Apr. 7, 2005.

(51) Int. Cl.

| | |
|---|---|
| ***A63B 22/00*** | (2006.01) |
| ***A63B 71/00*** | (2006.01) |
| ***A63B 9/00*** | (2006.01) |
| ***A63B 17/00*** | (2006.01) |
| ***A63B 1/00*** | (2006.01) |

(52) U.S. Cl. ..... 482/51; 482/35; 482/38

(58) Field of Classification Search ..... 482/51, 482/87, 148, 23, 14–17, 34–42, 66, 67, 78, 482/95, 96, 131, 133, 142, 83, 90; D12/128–133, D12/679, 686, 691, 814, 826; 434/255; 135/65, 135/75; 473/440; *A63B 1/00, 9/00, 17/00, A63B 22/00, 71/00*

See application file for complete search history.

(56) References Cited

U.S. PATENT DOCUMENTS

| | | | | |
|---|---|---|---|---|
| 761,514 | A | 5/1904 | Leininger | |
| 1,142,137 | A * | 6/1915 | Bathrick | 482/41 |
| 1,222,664 | A | 4/1917 | Pema | |
| 1,642,184 | A * | 9/1927 | Urso | 482/41 |
| 2,682,402 | A * | 6/1954 | McCarthy | 482/135 |
| 3,896,798 | A | 7/1975 | Simon | |
| 4,189,149 | A * | 2/1980 | Katsiaficas | 482/35 |
| 4,415,150 | A * | 11/1983 | Iezza | 482/42 |
| 4,902,000 | A | 2/1990 | Starks et al. | |
| 4,988,092 | A * | 1/1991 | Trout | 482/51 |
| 5,720,697 | A * | 2/1998 | Winkel | 482/41 |
| 5,755,641 | A * | 5/1998 | Pardella | 482/36 |
| 5,865,450 | A | 2/1999 | Ulrich | |
| 6,071,354 | A * | 6/2000 | Williams | 134/6 |
| 6,168,548 | B1 | 1/2001 | Fleming | |
| 6,217,484 | B1 * | 4/2001 | Harshman et al. | 482/51 |
| 6,352,234 | B1 | 3/2002 | Liu | |
| 6,367,823 | B1 | 4/2002 | Miyagi | |

(Continued)

OTHER PUBLICATIONS

I, Michael J. Monaghan, am the author/developer of both ot the documents listed below (#1 and #2).

(Continued)

*Primary Examiner*—Loan H Thanh
*Assistant Examiner*—Oren Ginsberg
(74) *Attorney, Agent, or Firm*—Kunzler Needham Massey & Thorpe

(57) ABSTRACT

A safe and fun exercise and walking-training apparatus and method that is ideal for infants in the approximate age range of 10 months to 18 months is disclosed. The apparatus is lightweight, very sturdy, very simple, consisting of only six unique elements, and may be assembled and disassembled by hand without tools. A system of attachable play features is also disclosed.

13 Claims, 10 Drawing Sheets

U.S. PATENT DOCUMENTS

| | | | | |
|---|---|---|---|---|
| 6,551,224 | B1 * | 4/2003 | Lim | 482/142 |
| 6,929,586 | B2 * | 8/2005 | Johnson | 482/41 |
| 6,976,945 | B1 * | 12/2005 | Lim | 482/148 |
| 2008/0207405 | A1 * | 8/2008 | Jung | 482/38 |

OTHER PUBLICATIONS

An informational brochure for First Toddle(R)—a 3-in-1 Infant/Toddler Play, Entertainment and Development System. (4-page copy attached), I developed this brochure, including professional photos (of the product, accessories, and in various play configurations) to show to interested parties., I've incorporated the brochure and it's informational content into the business play for my company, First Toddle, Inc., I've had the product tested by a professional testing lab and have identified child models who we'll photograph using First Toddle(R)., I'm manufacturing the product (and all accessories) through a company in San Diego (Advance Plastics, Inc.).

"The First Toddle(R) Child Development Guide(c)" (6-page copy attached), I developed this information guide to accompany First Toddle(R)—much better than a basic set of instructions., I've researched the content and have confirmed its accuracy several pediatricians., Document is being updated to include photographs were there are now only digitized images. Also removing reference to "Parallel Balance Beams".

* cited by examiner

INFANT ACTIVITY SYSTEMS

CROSS-REFERENCE TO RELATED APPLICATION

The present application is related to and claims priority from prior provisional application Ser. No. 60/669,540, filed Apr. 7, 2005, entitled "INFANT ACTIVITY SYSTEMS", and is related to and claims priority from prior provisional application Ser. No. 60/713,286, filed Aug. 31, 2005, entitled "INFANT ACTIVITY SYSTEMS", the contents of both of which are incorporated herein by this reference and are not admitted to be prior art with respect to the present invention by the mention in this cross-reference section.

BACKGROUND

This invention relates to providing a system for an improved walking training system for infants. More particularly, this invention relates to providing a system, for infant exercise and entertainment, which provides opportunities for walking training of infants learning to walk.

Frequently, children learn to walk by "furniture surfing" (e.g., infants who are just starting to stand, holding onto sofas and coffee tables as they navigate their way around a living room). At least in part, this may be due to the lack of an alternative method. Obviously, "furniture surfing" represents a risk to the infant, e.g., in the event the infant should fall against a sharp corner or edge.

A primary alternative to "furniture surfing" is "parent surfing", which involves the active participation of the adult in holding the infant's hands while the infant attempts to walk. This method is often short-lived due to adult fatigue.

Today, there are few readily available alternatives which provide the functional combination of walking training, exercise and entertainment. Generally, the currently readily available alternatives fail to provide at least one of the desired functions and often have significant safety limitations, even with parental supervision.

Heretofore, other solutions have tended to be heavy, expensive, complicated, difficult to set up, difficult to manufacture, and costly to manufacture. Additionally, safety-related features have been limited.

Therefore, a need exists for a system which is safe, inexpensive and easily manufactured, and which provides infant walking training in combination with other functions.

OBJECTS AND FEATURES OF THE INVENTION

A primary object and feature of the present invention is to provide a system for infant walking training.

It is a further primary object and feature of the present invention to provide such a system for promoting infant exercise.

It is another primary object and feature of the present invention to provide such a system for promoting infant entertainment.

It is an additional primary object and feature of the present invention to provide such a system for promoting infant walking training which is safe for infants.

It is another primary object and feature of the present invention to provide such a system adaptable to the training of older children and patient physical therapy.

It is yet another primary object and feature of the present invention to provide such a system which is inexpensive.

It is still a further primary object and feature of the present invention to provide such a system that is easily assembled, disassembled, transported and stored.

Another primary object and feature of the present invention is to provide such a system that is lightweight.

It is another primary object and feature of the present invention to provide such a system that is easily and inexpensively manufactured.

Other objects and features of this invention will become apparent with reference to the following descriptions.

SUMMARY OF THE INVENTION

In accordance with a preferred embodiment hereof, this invention provides an infant activity system, relating to providing unrestricted learning-to-walk oriented play activities to at least one infant, comprising: upper polygonal peripheral graspable bar means for grasping by the at least one infant; lower polygonal peripheral support means for supporting such upper polygonal peripheral graspable bar means in at least one fixed elevation position; and geometry means for permitting essentially free movement by the at least one infant throughout such infant activity system. Moreover, it provides such an infant activity system, wherein such geometry means comprises tilt-prevention means for essentially preventing tilting of such infant activity system when the at least one infant applies forces to such upper polygonal peripheral graspable bar means. Additionally, it provides such an infant activity system, wherein such lower polygonal peripheral support means comprises lower polygonal peripheral base means surrounding at least one base area for providing at least one lower polygonal peripheral base for such infant activity system. Also, it provides such an infant activity system, wherein such geometry means comprises tilt-prevention means for essentially preventing tilting of such infant activity system when the at least one infant applies forces to such upper polygonal peripheral graspable bar means. In addition, it provides such an infant activity system, wherein such tilt-prevention means comprises geometric retention means for geometrically retaining at least one center of gravity of such infant activity system within such at least one base area when the at least one infant applies forces to such upper polygonal peripheral graspable bar means. And, it provides such an infant activity system, further comprising attacher means for attaching such upper polygonal peripheral graspable bar means to such lower polygonal peripheral support means.

In accordance with another preferred embodiment hereof, this invention provides an infant activity system relating to providing unrestricted activities to at least one infant comprising in combination: at least one upper polygonal peripheral graspable bar adapted to be grasped by the at least one infant; at least one lower polygonal peripheral support adapted to support such at least one upper polygonal peripheral graspable bar in at least one fixed elevation position; and at least one geometric arrangement adapted to allow essentially free movement by the at least one infant throughout such infant activity system. Further, it provides such an infant activity system, wherein such at least one geometric arrangement comprises at least one tilt-prevention arrangement adapted to essentially prevent tilting of such infant activity system when the at least one infant applies forces to such at least one upper polygonal peripheral graspable bar. Even further, it provides such an infant activity system, wherein such lower polygonal peripheral support comprises: at least one lower polygonal peripheral base surrounding at least one base area; wherein at least one geometric relationship between such at least one lower polygonal peripheral base and such at least one upper polygonal peripheral graspable bar allows retention of at least one center of gravity of such infant activity system within such at least one base area when the at least one infant applies forces to such upper polygonal peripheral graspable bar; and at least one attacher adapted to attach such at least one lower polygonal peripheral base to such at least one upper polygonal peripheral graspable bar. Moreover, it provides such an infant activity system, wherein such at least one lower polygonal peripheral base comprises: at least six end bars, each of essentially equal length; at least two side bars, each of essentially equal length; at least four 90-degree elbow bar connectors; and at least four tee bar connectors. Additionally, it provides such an infant activity system, wherein such at least one attacher comprises at least four attacher bars, each of essentially equal length. Also, it provides such an infant activity system, wherein such at least one upper polygonal peripheral graspable bar comprises: at least two end bars, each of essentially equal length; at least two side bars, each of essentially equal length; and at least four three-way elbow bar connectors.

In accordance with another preferred embodiment hereof, this invention provides a kit system for assembling at least one infant activity system relating to providing unrestricted learning-to-walk activities to at least one infant comprising: at least one side bar set; at least one attacher bar set; at least one end bar set; at least one connector set; at least one container; at least one assembly instruction sheet; and at least one indicia; wherein such at least one side bar set, such at least one attacher bar set, such at least one end bar set, and such at least one connector set are assembled to provide such infant activity system. In addition, it provides such a kit system, wherein such at least one side bar set comprises at least four side bars, each of essentially equal length. And, it provides such a kit system, wherein such at least four side bars comprise schedule 40 polymerized vinyl chloride pipe. Further, it provides such a kit system, wherein such at least four side bars comprise color coding. Even further, it provides such a kit system, wherein such at least one end bar set comprises at least eight end bars, each of essentially equal length. Moreover, it provides such a kit system, wherein such at least eight end bars comprise schedule 40 polymerized vinyl chloride pipe. Additionally, it provides such a kit system, wherein such at least eight end bars comprise color coding. Also, it provides such a kit system, wherein such at least one connector set comprises: at least four three-way elbow bar connectors; at least four 90-degree elbow bar connectors; and at least four tee bar connectors. In addition, it provides such a kit system, wherein: such at least four three-way elbow bar connectors comprise schedule 40 polymerized vinyl chloride; such at least four 90-degree elbow bar connectors comprise schedule 40 polymerized vinyl chloride; and such at least four tee bar connectors comprise schedule 40 polymerized vinyl chloride. And, it provides such a kit system, wherein: such at least four three-way elbow bar connectors comprise color coding; such at least four 90-degree elbow bar connectors comprise color coding; and such at least four tee bar connectors comprise at least one color coded-element. Further, it provides such a kit system, wherein such at least one attacher bar set comprises at least four attacher bars, each of essentially equal length. Even further, it provides such a kit system, wherein such at least four attacher bars comprise schedule 40 polymerized vinyl chloride pipe. Even further, it provides such a kit system, wherein such at least four attacher bars comprise color coding. Even further, it provides such a kit system, wherein such at least one container permits easy storage of such at least one infant activity system after disassembly.

Furthermore, it provides such a kit system, further comprising at least one removably attachable play feature adapted to removably attach to such at least one infant activity system. In addition, it provides such a kit system, wherein said at least one removably attachable play feature comprises at least one sports related function. Furthermore, it provides such a kit system, wherein said at least one removably attachable play feature comprises at least one basketball hoop. And, it provides such a kit system, wherein said at least one removably attachable play feature comprises at least one soccer net. Furthermore, it provides such a kit system, wherein said at least one removably attachable play feature comprises: at least one soft toy; wherein said at least one soft toy comprises at least one removable attacher adapted to removably attach said at least one soft toy to said infant activity system. Furthermore, it provides such a kit system, wherein said at least one removably attachable play feature comprises at least one cover adapted to cover at least one portion of said infant activity system.

In accordance with another preferred embodiment hereof, this invention provides an infant activity system assembly method for at least one infant activity system, relating to providing unrestricted learning-to-walk oriented play activities to at least one infant, comprising upper polygonal peripheral graspable bar means for providing at least one polygonal peripheral graspable bar for grasping by such at least one infant; lower polygonal peripheral support means for supporting such upper polygonal peripheral graspable bar means in at least one fixed elevation position; and geometry means for permitting essentially free movement by such at least one infant throughout such infant activity system, comprising the steps of: providing at least one set of modular components; wherein such at least one set of modular components comprises at least one set of bars having essentially the same outside diameter, and at least one set of connectors having essentially the same inside diameter; and assembling such at least one set of bars and such at least one set of connectors without tools to produce such at least one infant activity system. Even further, it provides such an infant activity system assembly method, wherein such at least one set of bars comprises: at least eight end bars, each of essentially equal length; at least four side bars, each of essentially equal length; and at least four attacher bars. Even further, it provides such an infant activity system assembly method, wherein such at least one set of connectors comprises: at least four three-way elbow bar connectors; at least four 90-degree elbow bar connectors; and at least four tee bar connectors.

DETAILED DESCRIPTION OF THE BEST MODES AND PREFERRED EMBODIMENTS OF THE INVENTION

Figure 1:
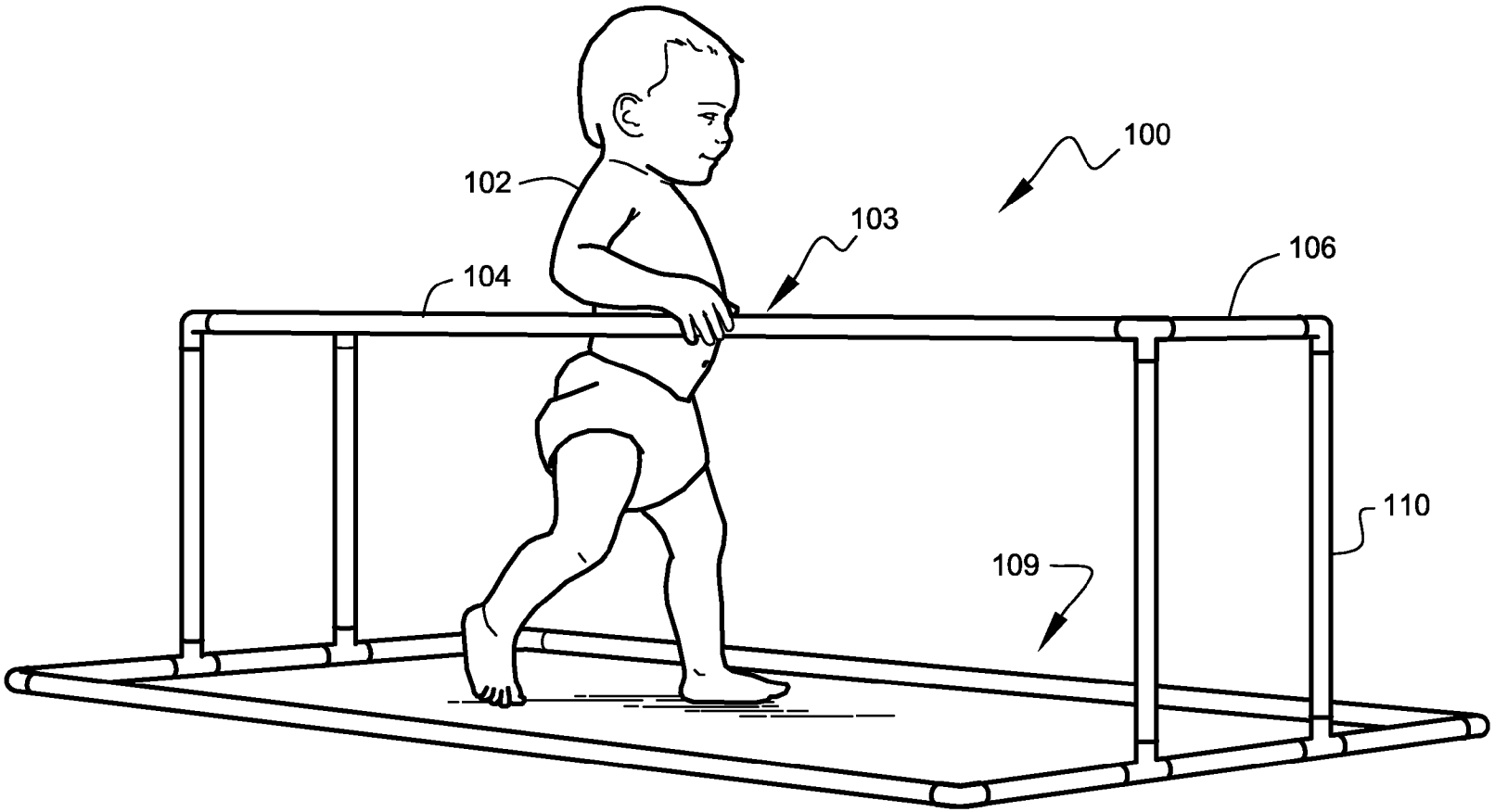
FIG. 1 shows a perspective view of an infant activity system according to a preferred embodiment of the present invention and illustrating an infant using such system.

FIG. 1 shows a perspective view illustrating an infant activity system 100 according to a preferred embodiment of the present invention.

As shown, the infant activity system 100 comprises a group of bars and connectors preferably configured to provide a stable and safe system on which children can play while learning to walk. Preferably, the infant activity system 100 is configured to allow the infant to move in all directions around, under and through the infant activity system 100 essentially without limitation to promote interest and continuous usage for more than a few brief moments. Preferably, the infant activity system 100 is configured to allow a parent to assemble or disassemble system 100 without the use of tools because all connectors and bars are preferably friction-fittable without the use of fasteners. Preferably, the infant activity system 100 is configured to fit about 80 to about 90 percent of children approximately ten to eighteen months of age. Larger preferred embodiments of the present invention are suited to the training of physically challenged individuals and in patient physical therapy.

Preferably, as illustrated by FIG. 1 the infant 102 may walk or stand within the upper polygonal peripheral graspable bar 103 of the infant activity system 100 according to a preferred embodiment of the present invention. Because all sides of the infant activity system 100 are open, the infant 102 preferably may stand or walk on the outside of the upper polygonal peripheral graspable bar 103 (at least herein embodying upper polygonal peripheral graspable bar means for grasping by the at least one infant). Additionally, the infant 102 may also preferably use any attacher bar 110, the upper end bar 106, or the upper side bar 104 to pull itself up to a standing position because of the stability of the infant activity system 100 preferably provided by the geometric relationship of the upper polygonal peripheral graspable bar 103 and the lower polygonal peripheral support 109 (at least herein embodying lower polygonal peripheral support means for supporting said upper polygonal peripheral graspable bar means in at least one fixed elevation position). Preferably, as shown, the lower polygonal peripheral support 109 is at least three times the width of the upper polygonal peripheral graspable bar 103 and is preferably attached to the outer perimeter of the lower polygonal peripheral support 109 (as shown and described in FIG. 2 e.g., lower end bars 114 are cumulatively at least three times longer than upper end bar 106)(at least herein embodying attacher means for attaching said upper polygonal peripheral graspable bar means to said lower polygonal peripheral support means). According to a preferred embodiment of the present invention, these preferred geometric arrangements allow retention of the center of gravity of the infant activity system 100 within the area circumscribed by the lower polygonal peripheral support 109 when an infant 102 applies forces to the upper polygonal peripheral graspable bar 103 (at least herein embodying geometry means for permitting essentially free movement by the at least one infant throughout said infant activity system; at least herein embodying wherein said geometry means comprises tilt-prevention means for essentially preventing tilting of said infant activity system when the at least one infant applies forces to said upper polygonal peripheral graspable bar means; at least herein embodying wherein said lower polygonal peripheral support means comprises lower polygonal peripheral base means surrounding at least one base area for providing at least one lower polygonal peripheral base for said infant activity system; at least herein embodying wherein said geometry means comprises tilt-prevention means for essentially preventing tilting of said infant activity system when the at least one infant applies forces to said upper polygonal peripheral graspable bar means; at least herein embodying wherein said tilt-prevention means comprises geometric retention means for geometrically retaining at least one center of gravity of said infant activity system within such at least one base area when the at least one infant applies forces to said upper polygonal peripheral graspable bar means).

Figures 2, 3:
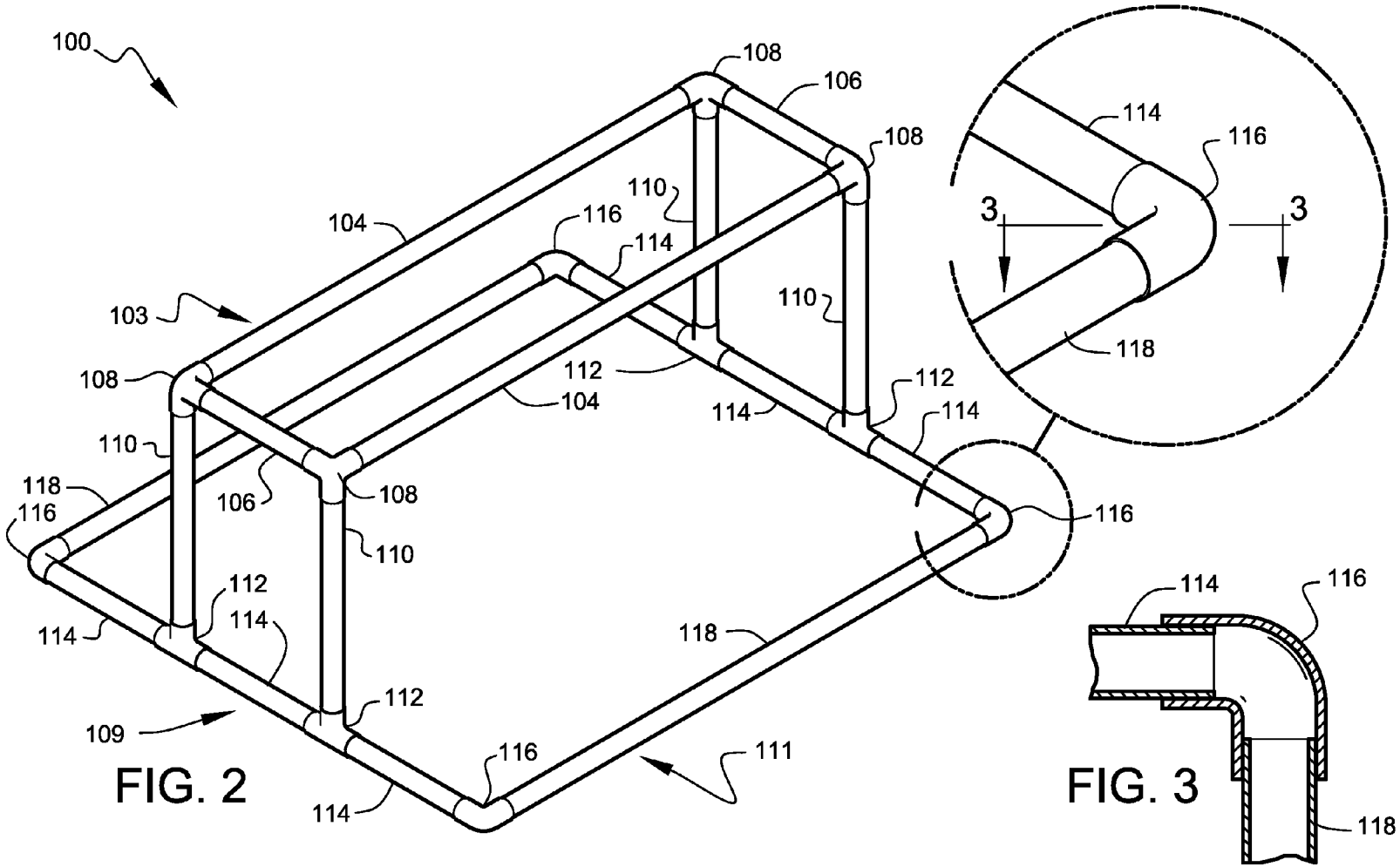
FIG. 2 shows a perspective view of the infant activity system according to the preferred embodiment of FIG. 1.
FIG. 3 shows the section 3-3 of FIG. 2 illustrating a preferred component fit method for the infant activity system according to the preferred embodiment of FIG. 2.

FIG. 2 shows a perspective view of the infant activity system according to a preferred embodiment of the present invention. Preferably, the infant activity system 100 comprises at least one upper polygonal peripheral graspable bar 103 adapted to provide a graspable bar for grasping by an infant 102, as shown (at least herein embodying at least one upper polygonal peripheral graspable bar adapted to be grasped by the at least one infant). Preferably, the upper polygonal peripheral graspable bar 103 is comprised of two upper side bars 104, two upper end bars 106 and four three-way elbow bar connectors 108, as shown (at least herein embodying at least two end bars, each of essentially equal length; at least herein embodying at least two side bars, each of essentially equal length; at least herein embodying at least four three-way elbow bar connectors). Further, a lower polygonal peripheral support 109 is adapted preferably to support such at least one upper polygonal peripheral graspable bar 103 at a fixed height and in a fixed position, as shown (at least herein embodying at least one lower polygonal peripheral support adapted to support said at least one upper polygonal peripheral graspable bar in at least one fixed elevation position).

According to a preferred embodiment of the present invention, the geometric arrangement of the upper polygonal peripheral graspable bar 103, the attacher bars 110 and the lower polygonal peripheral support 109 preferably allows the infant 102 essentially movement around and through the infant activity system 100 (at least herein embodying at least one geometric arrangement adapted to permit essentially free movement by the at least one infant throughout said infant activity system).

Preferably, as shown, the lower polygonal peripheral support 109 is at least three times the width of the upper polygonal peripheral graspable bar 103 and is preferably attached to the outer perimeter of the lower polygonal peripheral support 109 because preferably the lower end bars 114 are cumulatively at least three times longer than the upper end bars 106 (at least herein embodying wherein said at least one geometric arrangement comprises at least one tilt-prevention arrangement adapted to essentially prevent tilting of said infant activity system when the at least one infant applies forces to said at least one upper polygonal peripheral graspable bar; at least herein embodying at least one lower polygonal peripheral base surrounding at least one base area; at least herein embodying wherein at least one geometric relationship between said at least one lower polygonal peripheral base and said at least one upper polygonal peripheral graspable bar permits retention of at least one center of gravity of said infant activity system within such at least one base area when the at least one infant applies forces to said upper polygonal peripheral graspable bar; at least herein embodying at least one attacher adapted to attach said at least one lower polygonal peripheral base to said at least one upper polygonal peripheral graspable bar).

Preferably, as shown, the lower polygonal peripheral support 109 comprises at least one lower polygonal peripheral base 111 and four attacher bars 110 of essentially equal length (at least herein embodying wherein said at least one attacher comprises at least four attacher bars, each of essentially equal length). Preferably, the polygonal peripheral base 111 comprises at least six lower end bars 114, at least two lower side bars 118, at least four 90-degree elbow bar connectors 116 and at least four tee (T-shaped, herein sometimes "tee" or "T") bar connectors 112, as shown (at least herein embodying at least six end bars, each of essentially equal length; at least herein embodying at least two side bars, each of essentially equal length; at least herein embodying at least four 90-degree elbow bar connectors; at least herein embodying at least four tee bar connectors).

Preferably, all bars (including upper side bar 104, upper end bar 106, attacher bar 110, lower end bar 114, and lower side bar 118) comprise nominal one-inch outside diameter industry-standard plastic piping, preferably industry-standard polymerized vinyl chloride solid wall pipe, preferably industry-standard schedule 40 polymerized vinyl chloride solid wall pipe, which piping is well known in the plumbing industry and readily available commercially (at least herein embodying wherein said at least four side bars comprise schedule 40 polymerized vinyl chloride; at least herein embodying wherein said at least eight end bars comprise schedule 40 polymerized vinyl chloride pipe; at least herein embodying wherein said at least four attacher bars comprise schedule 40 polymerized vinyl chloride pipe; and at least herein embodying at least one set of bars having essentially the same outside diameter). Preferably, all connectors (including three-way elbow bar connector 108, tee bar connector 112 and 90-degree elbow bar connector 116) are nominal one-inch inside diameter industry-standard plastic connectors, preferably industry-standard polymerized vinyl chloride solid wall connectors, preferably industry-standard schedule 40 polymerized vinyl chloride solid wall connectors (at least herein embodying said at least four three-way elbow bar connectors comprise schedule 40 polymerized vinyl chloride; said at least four 90-degree elbow bar connectors comprise schedule 40 polymerized vinyl chloride; and said at least four tee bar connectors comprise schedule 40 polymerized vinyl chloride; and at least herein embodying at least one set of connectors having essentially the same inside diameter). Preferably, use of industry-standard pipe and connectors allows a reliable dry friction fit between the bars and connectors. Upon reading the teachings of this specification, those with ordinary skill in the art will now understand that, under appropriate circumstances, considering issues such as cost, material availability, weight, durability, infant safety, market demand, etc., other pipe arrangements, such as, for example, the use of polymerized vinyl chloride pipe with other diameters such as nominal outside diameters of 1½ inches, 2 inches, etc., may suffice. Upon reading the teachings of this specification, those with ordinary skill in the art will now understand that, under appropriate circumstances, considering issues such as cost, material availability, weight, durability, infant safety, market demand, etc., other connector arrangements, such as, for example, the use of polymerized vinyl chloride connectors with other inside diameters such as nominal inside diameter of 1½ inches, nominal inside diameter of 2 inches, etc., may suffice.

Preferably, each upper side bar 104 and each lower side bar 118 are essentially the same length. Preferably, each upper side bar 104 and each lower side bar 118 are about 30 inches in length. Preferably, each attacher bar 110 is about 15 inches in length (length adjustable embodiments are discussed in FIG. 17). Preferably, each upper end bar 106 and each lower end bar 114 are essentially the same length. Preferably, upper end bar 106 and lower end bar 114 are about eight inches in length. Upon reading the teachings of this specification, those with ordinary skill in the art will now understand that, under appropriate circumstances, considering issues such as cost, material availability, weight, durability, infant safety, market demand, etc., other bar length arrangements, such as, for example, an upper side bar and lower side bar with other lengths, such as about 36 inches, and an upper end bar and a lower end bar with other lengths, such as about 9 inches, etc., may suffice.

FIG. 3 shows the section 3-3 of FIG. 2 illustrating a preferred component fit method for the infant activity system according to the preferred embodiment of FIG. 2. An example of all pipe and connector connections is shown in the section view 3-3 where, for example, a lower end bar 114 and a lower side bar 118 are preferably dry-fitted into a 90-degree elbow bar connector 116. Preferably, this dry-fit system allows the infant activity system 100 to be assembled by hand, without the use of tools, adhesives or fasteners, which greatly simplifies the assembly/disassembly process for the user (at least herein embodying assembling such at least one set of bars and such at least one set of connectors without tools to produce such at least one infant activity system). Additionally, the close tolerances of industry-standard schedule 40 polymerized vinyl chloride solid wall connectors and industry-standard schedule 40 polymerized vinyl chloride solid wall pipes preferably allow the infant activity system 100 to be very stable.

Figure 4:
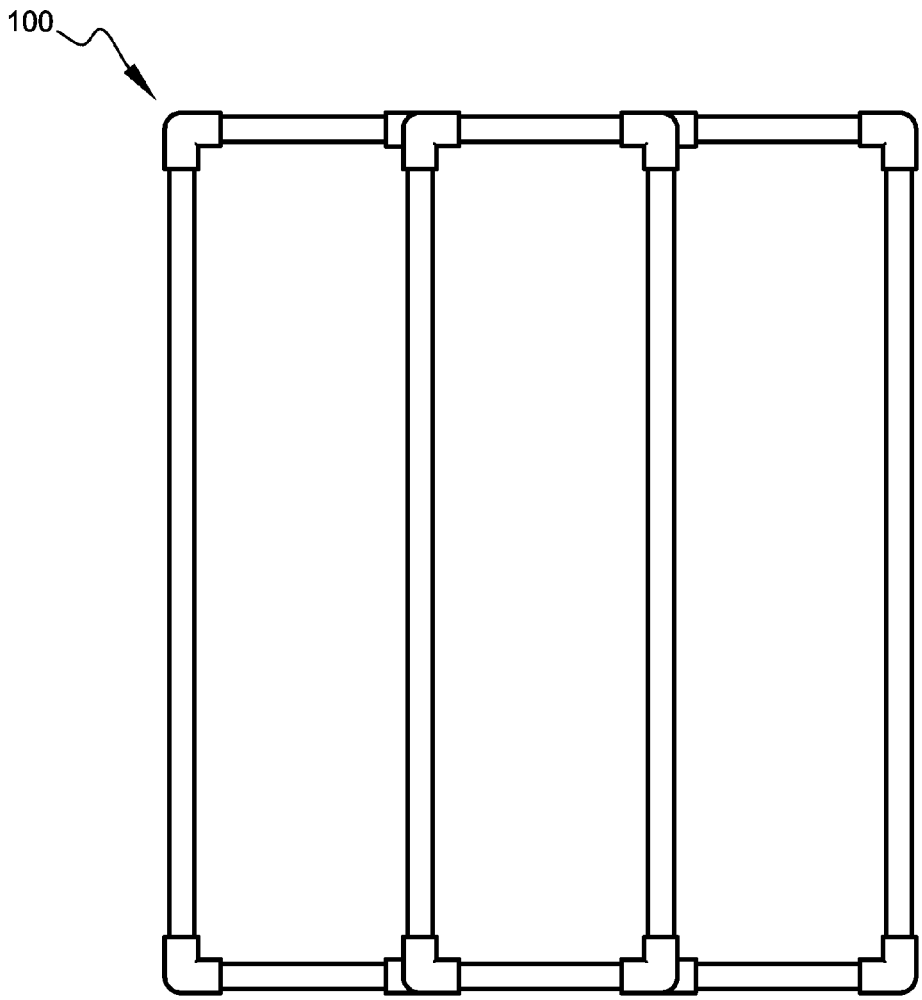
FIG. 4 shows a top elevational view of the infant activity system according to the preferred embodiment of FIG. 2.

FIG. 4 shows a top elevational view of the infant activity system 100 according to the preferred embodiment of FIG. 2.

Figure 5:
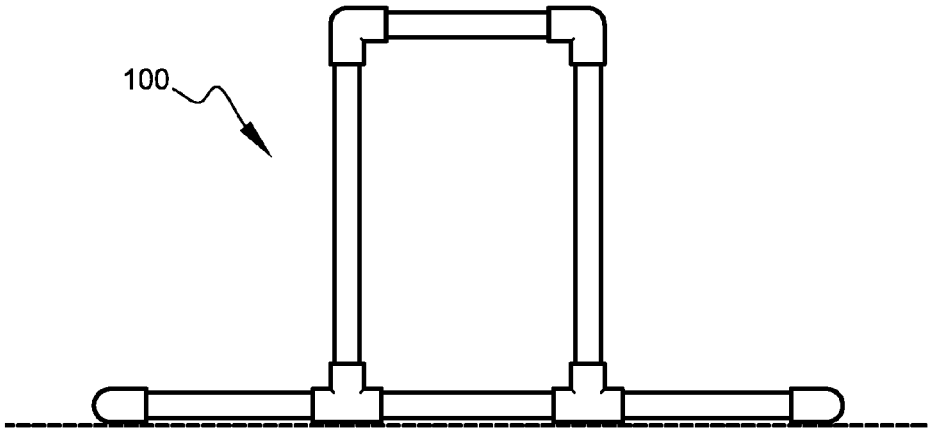
FIG. 5 shows an end elevational view of the infant activity system according to the preferred embodiment of FIG. 2.

FIG. 5 shows an end elevational view of the infant activity system 100 according to the preferred embodiment of FIG. 2.

Figure 6:
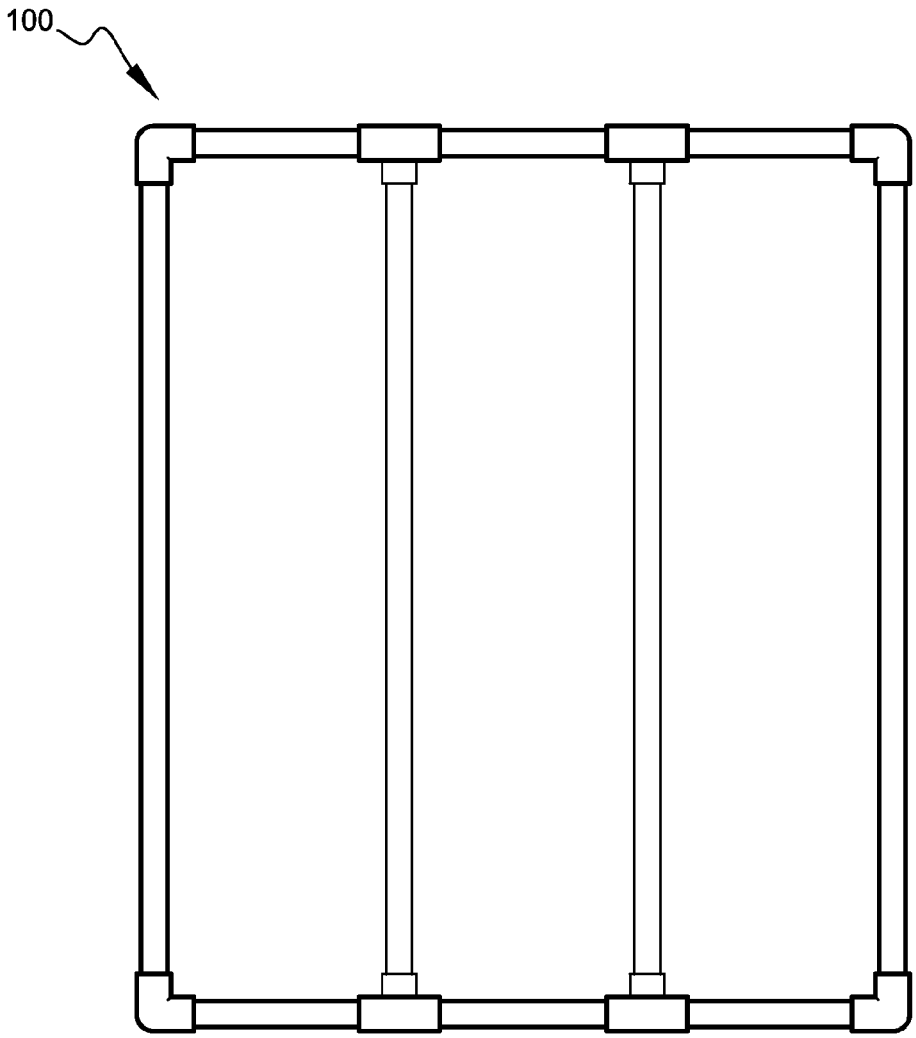
FIG. 6 shows a bottom elevational view of the infant activity system according to the preferred embodiment of FIG. 2.

FIG. 6 shows a bottom elevational view of the infant activity system according to the preferred embodiment of FIG. 2.

Figure 7:
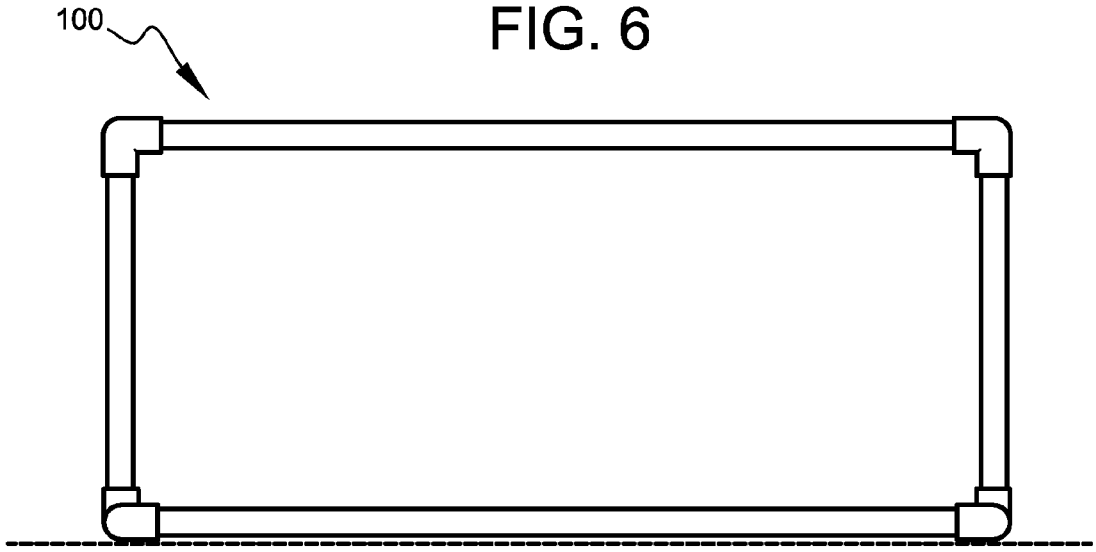
FIG. 7 shows a side elevational view of the infant activity system according to the preferred embodiment of FIG. 2.

FIG. 7 shows a side elevational view of infant activity system 100 according to the preferred embodiment of FIG. 2.

Figure 8:
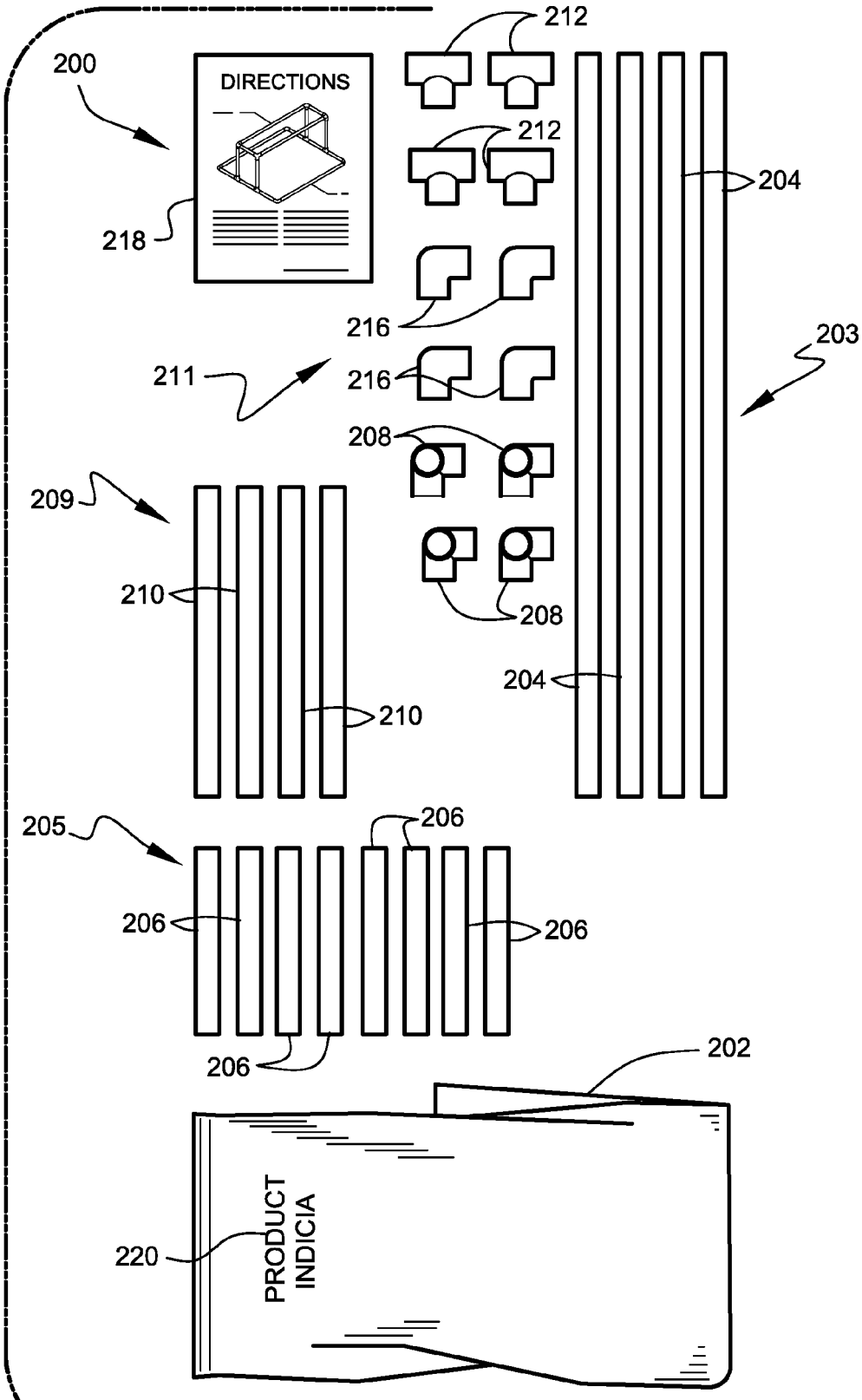
FIG. 8 shows a preferred infant activity system kit, illustrating the primary components of the kit preferably used to make up the infant activity system according to the preferred embodiment of FIG. 2.

FIG. 8 shows the preferred infant activity system kit 200, illustrating the primary components used to assemble the infant activity system according to the preferred embodiment of FIG. 2 (at least herein embodying wherein said at least one side bar set, said at least one attacher bar set, said at least one end bar set, and said at least one connector set are assembled to provide said infant activity system; and at least herein embodying providing at least one set of modular components). The infant activity system 100 is preferably provided as an infant activity system kit 200 that preferably comprises, as shown:

at least one side bar set 203 comprising at least four side bars 204 of essentially equal length (at least herein embodying at least one side bar set; and at least herein embodying wherein said at least one side bar set comprises at least four side bars, each of essentially equal length);

at least one attacher bar set 209 comprising at least four attacher bars 210 of essentially equal length (at least herein embodying at least one attacher bar set; and at least herein embodying wherein said at least one attacher bar set comprises at least four attacher bars, each of essentially equal length);

at least one end bar set 205 comprising at least eight end bars 206 of essentially equal length (at least herein embodying at least one end bar set; and at least herein embodying wherein said at least one end bar set comprises at least eight end bars, each of essentially equal length);

at least one connector set 211 comprising at least four three-way elbow bar connectors 208, at least four 90-degree elbow bar connectors 216, and at least four tee bar connectors 212 (at least herein embodying at least one connector set; and at least herein embodying wherein said at least one connector set comprises: at least four three-way elbow bar connectors; at least four 90-degree elbow bar connectors; and at least four tee bar connectors); at least one flexible bag container 202 (at least one container at least one container); and at least one assembly instruction sheet 218 (at least herein embodying at least one assembly instruction sheet).

Preferably, both the flexible bag container 202 and the assembly instruction sheet 218 will include the product name indicia 220 (at least herein embodying at least one indicia). Preferably, the flexible bag container 202 is reusable and intended to allow all components of the disassembled infant activity system 100 to be conveniently and easily stored (at least herein embodying wherein said at least one container allows easy storage of such at least one infant activity system after disassembly).

Preferably, all components may be color-coded using a variety of colors to facilitate assembly and/or to improve marketability of the infant activity system 100. Preferably, side bar 204 and/or end bar 206 may be color-coded in one color, preferably red (at least herein embodying wherein said at least four side bars comprise color coding; and at least herein embodying wherein said at least eight end bars comprise color coding). Preferably, attacher bar 210 may be color-coded in one color, preferably blue (at least herein embodying wherein said at least four attacher bars comprise color coding). Preferably, essentially each three-way elbow bar connector 208, tee bar connector 212 and 90-degree elbow bar connector 216 may be color-coded in one color, preferably white (at least herein embodying wherein: said at least four three-way elbow bar connectors comprise color coding said at least four 90-degree elbow bar connectors comprise color coding; and said at least four tee bar connectors comprise at least one color coded-element).

Infant activity system kit 200 of FIG. 8 shows a preferred embodiment illustrating the primary components of the kit preferably used to make up infant activity system 100.

Figures 9, 10:
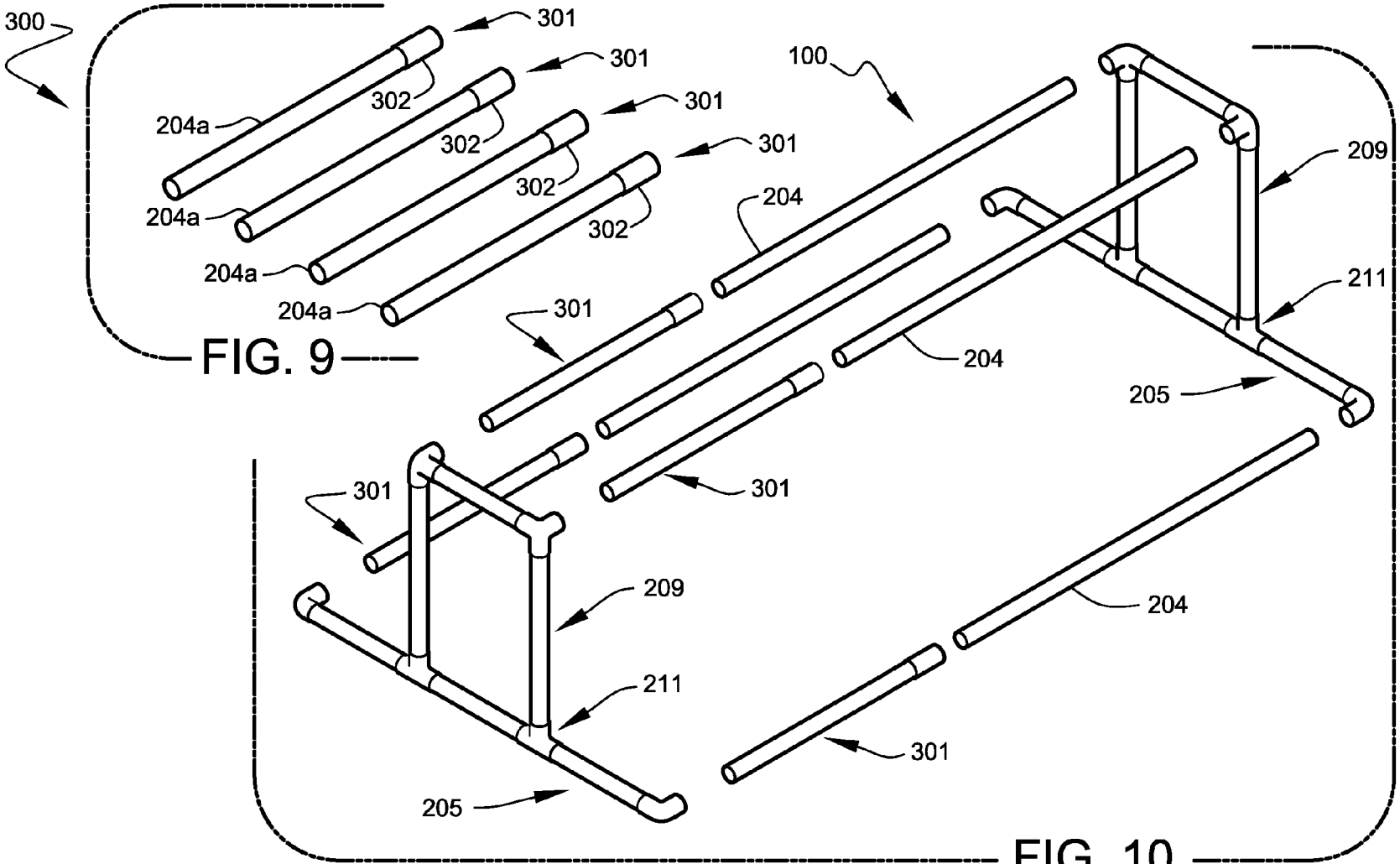
FIG. 9 shows a perspective view of a side bar extender set of the infant activity system kit of FIG. 8.
FIG. 10 shows an exploded perspective view of the side bar extender set of FIG. 9, including assembled components of the infant activity system.

FIG. 9 shows a perspective view of side bar extender set 300 of infant activity system kit 200 of FIG. 8, according to a preferred embodiment of the present invention. FIG. 10 shows an exploded perspective view of side bar extender set 300 of FIG. 9, including partially assembled components of infant activity system kit 200. Preferred embodiments of infant activity system kit 200 comprise side bar extender set 300, as shown (at least embodying herein at least one side bar extender set; wherein such at least one side bar extender set comprises at least four side extender bars, each of essentially equal length; and at least four linear bar connectors). Preferably, side bar extender set 300 is adapted to lengthen side bars 204 of infant activity system 100, as shown. Preferably, each side bar extender 301 of side bar extender set 300 comprises side bar **204*a* and linear bar connector 302, as shown. Preferably, side bar 204*a* and linear bar connector 302 are interconnectable with the above-described components of infant activity system 100, as shown. Preferably, side bar 204*a* and linear bar connector 302 are constructed from materials substantially matching those of infant activity system 100. Preferably, side bar extender set 300 comprises four side bars 204*a* and four linear bar connectors 302**, as shown. Upon reading the teachings of this specification, those with ordinary skill in the art will now understand that, under appropriate circumstances, considering issues such as commercial markets, intended use, etc., other kit arrangements, such as, for example, supplying extender bars as the sole element of an upgrade kit, providing additional extender for other portions of the system, etc., may suffice.

Preferably, to provide added user convenience, portions of infant activity system kit 200 are factory preassembled (at least embodying herein wherein said at least one attacher bar set, said at least one end bar set, and said at least one connector set are factory pre-assembled). Preferably, end bar set 205, attacher bar set 209, and connector set 211, are preassembled at the factory prior to shipping, as shown. Upon reading the teachings of this specification, those with ordinary skill in the art will now understand that, under appropriate circumstances, considering issues such as preferred shipping size, intended use, etc., other kit arrangements, such as, for example, providing fully assembled units, etc., may suffice. Furthermore, upon reading the teachings of this specification, those with ordinary skill in the art will now understand that, under appropriate circumstances, considering issues such as cost, consumer demand etc., other end support arrangements, such as, for example, producing a unitary molded unit replacing the end bar set, attacher bar set, and connector set, etc., may suffice.

Figure 11:
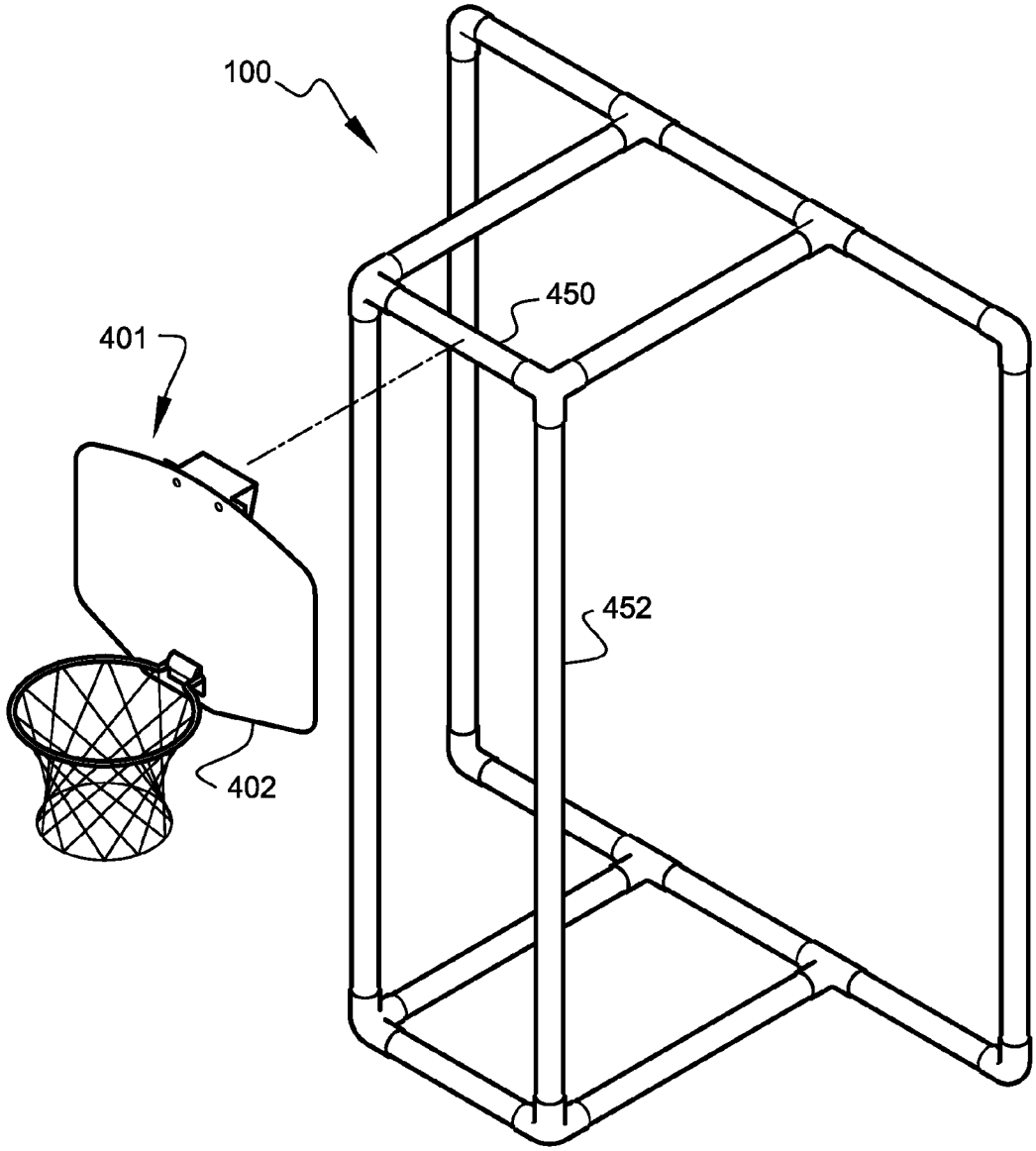
FIG. 11 shows a perspective view of an attachable play feature of the infant activity system kit of FIG. 8.
Figure 12:
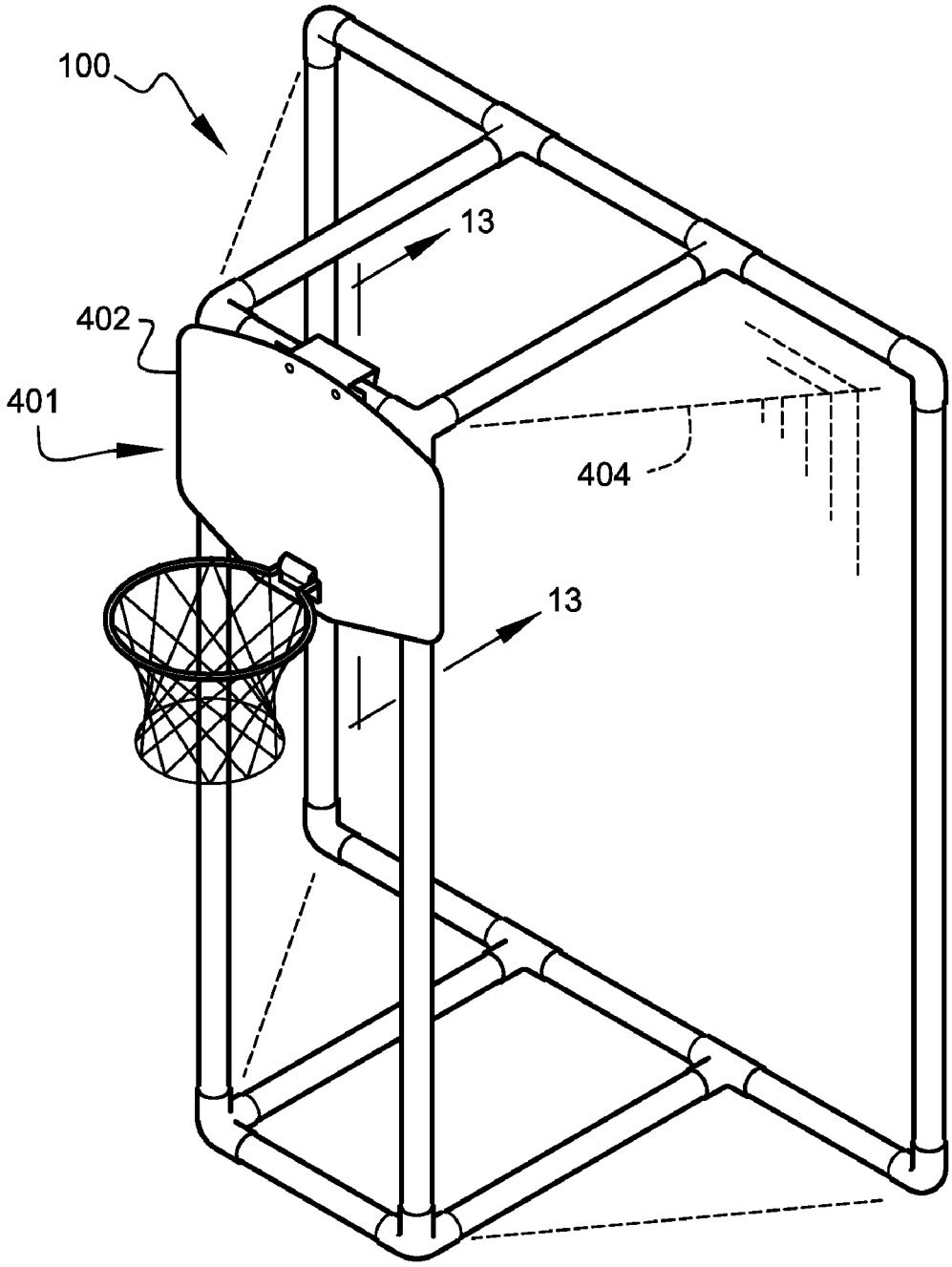
FIG. 12 shows a perspective view of the attachable play feature of FIG. 10, removably mounted to the infant activity system.

FIG. 11 shows a perspective view of attachable play feature 401 of infant activity system kit 200 of FIG. 8, according to a preferred embodiment of the present invention. FIG. 12 shows a perspective view of attachable play feature 401 of FIG. 10, removably mounted to infant activity system 100. Preferred embodiments of infant activity system kit 200 further comprise attachable play features 401 adapted to enhance the functionality of infant activity system 100 (at least embodying herein at least one removably attachable play feature adapted to removably attach to such at least one infant activity system). FIG. 11 and FIG. 12 illustrate the use of attachable play feature 401 having a sports related theme, in conjunction with infant activity system 100, as shown. More specifically, FIG. 11 and FIG. 12 illustrate the use of attachable play feature 401 comprising basketball hoop 402 (at least embodying herein wherein such at least one removably attachable play feature comprises at least one sports related function and such at least one removably attachable play feature comprises at least one basketball hoop). Preferably, basketball hoop 402 is of a type used with basketballs of reduced size, especially basketballs of foam construction. Preferably, basketball hoop 402 comprises a hoop diameter of about six inches and a backboard dimension of about 12 inches by 12 inches, as shown. Preferably, basketball hoop 402 is constructed from an appropriately durably material, most preferably plastic. Upon reading the teachings of this specification, those with ordinary skill in the art will now understand that, under appropriate circumstances, considering issues such as sport theme, intended use, etc., the use of other basketball hoop features, such as, for example, team logos, indcia, etc., may suffice.

Preferably, attachable play feature 401 is adaptable to comprise a wide range of sports related attachments including goal net 404 (as depicted in FIG. 12 with dashed lines), as shown. Preferably, goal net 404 is adapted to convert infant activity system 100 to an alternate sports related use, preferably a soccer or hockey goal, as shown. Upon reading the teachings of this specification, those of ordinary skill in the art will now understand that, under appropriate circumstances, considering such issues as intended use, age of user, regional activity preference, etc., other sport arrangements, such as, for example, converting the system for use as a football training target, golf drive practice net, etc., may suffice.

Figure 13:
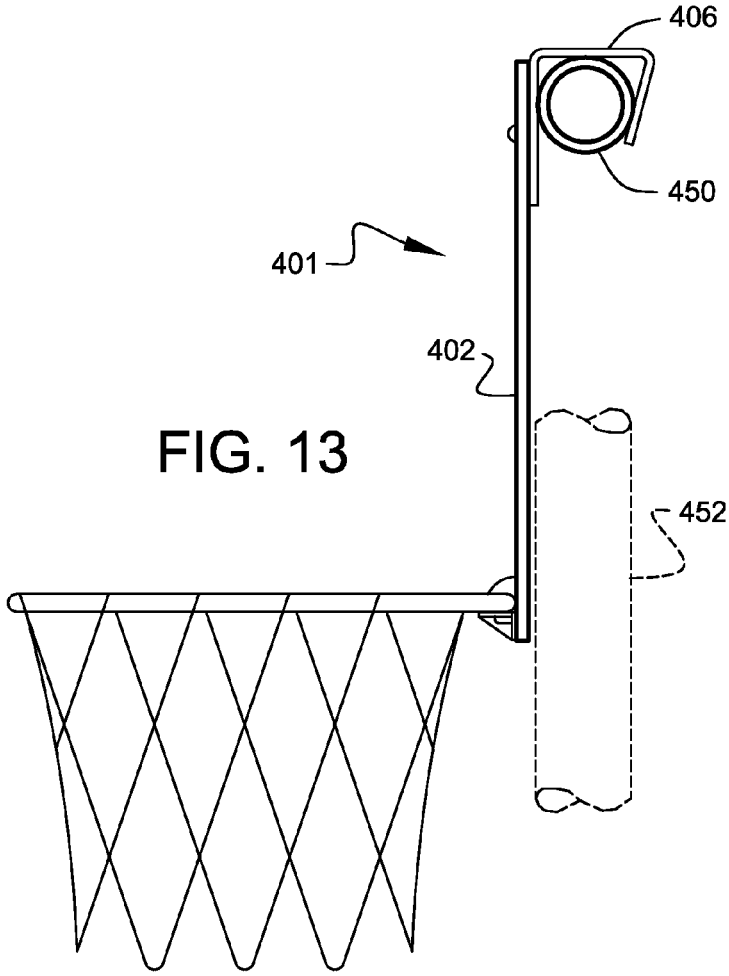
FIG. 13 shows the sectional view 13-13 of FIG. 12.

FIG. 13 shows the sectional view 13-13 of FIG. 12. Preferably, basketball hoop 402 comprises coupler support 406, as shown. Preferably, coupler support 406 is adapted to support basketball hoop 402 by engaging a horizontally oriented bar 450 of infant activity system 100, as shown. Preferably, basketball hoop 402 is adapted to be stabilized by one or more vertically oriented bars 452 of infant activity system 100, as shown.

Figure 14:
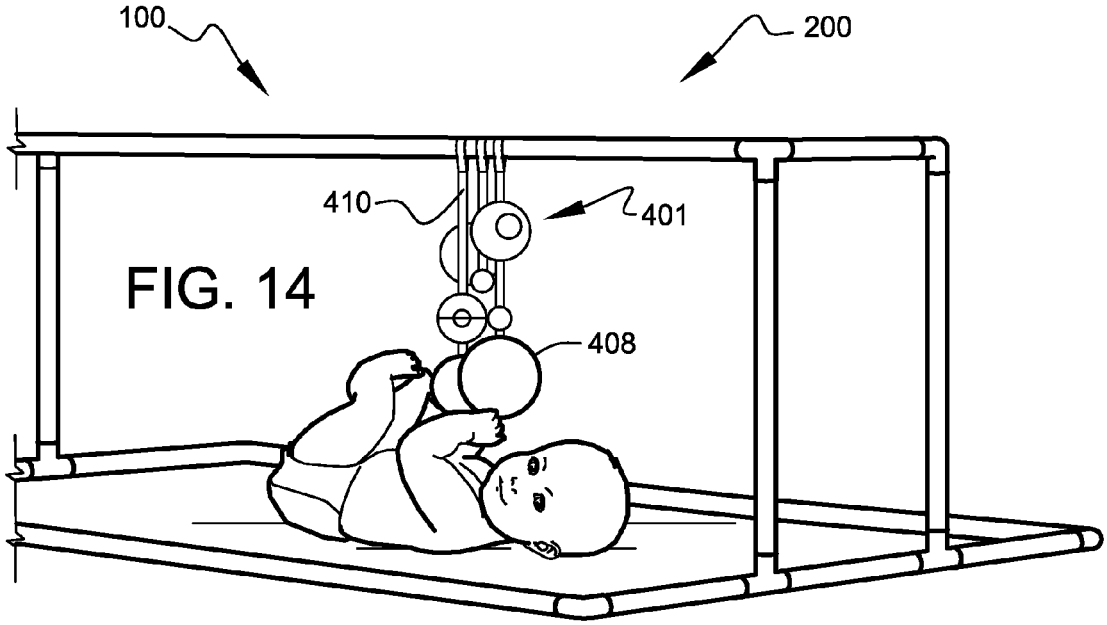
FIG. 14 shows a perspective view of another attachable play feature of the infant activity system kit of FIG. 8.

FIG. 14 shows a perspective view of another attachable play feature 401 of infant activity system kit 200 of FIG. 8. Preferred embodiments of infant activity system kit 200 further comprise soft toy embodiments of attachable play feature 401, such as soft toy 408, as shown (at least embodying herein at least one soft toy; wherein said at least one soft toy comprises at least one removable attacher adapted to removably attach said at least one soft toy to said infant activity system). Preferably, soft toy 408 comprises at least one removable fastener, preferably a hook-and-loop fastener identified herein as fastener 410. Preferably, fastener 410 is adapted to firmly hold soft toy 408 suspended above the child user while providing a breakaway safety feature if more than a predetermined weight is applied to soft toy 408.

Figure 15:
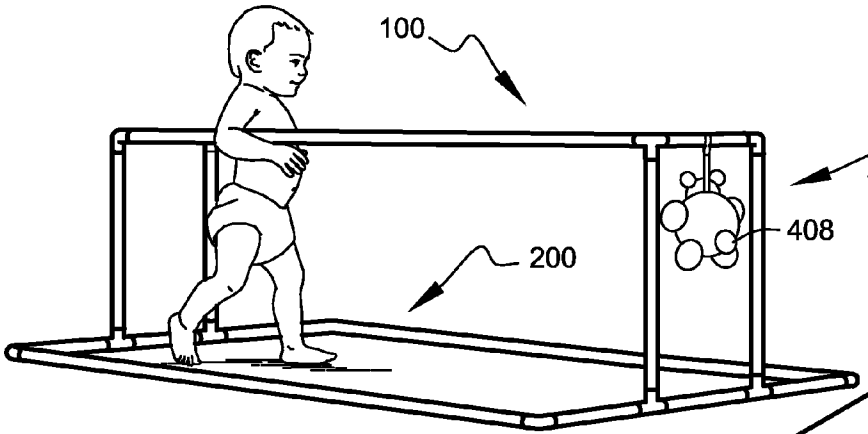
FIG. 15 shows a perspective view of another attachable play feature of the infant activity system kit of FIG. 8.

FIG. 15 shows a perspective view of another preferred embodiment of attachable play feature 401 of infant activity system kit 200 of FIG. 8. Preferably, soft toy 408 of FIG. 15 has been located to draw the child user into walking the length of infant activity system 100.

Figure 16:
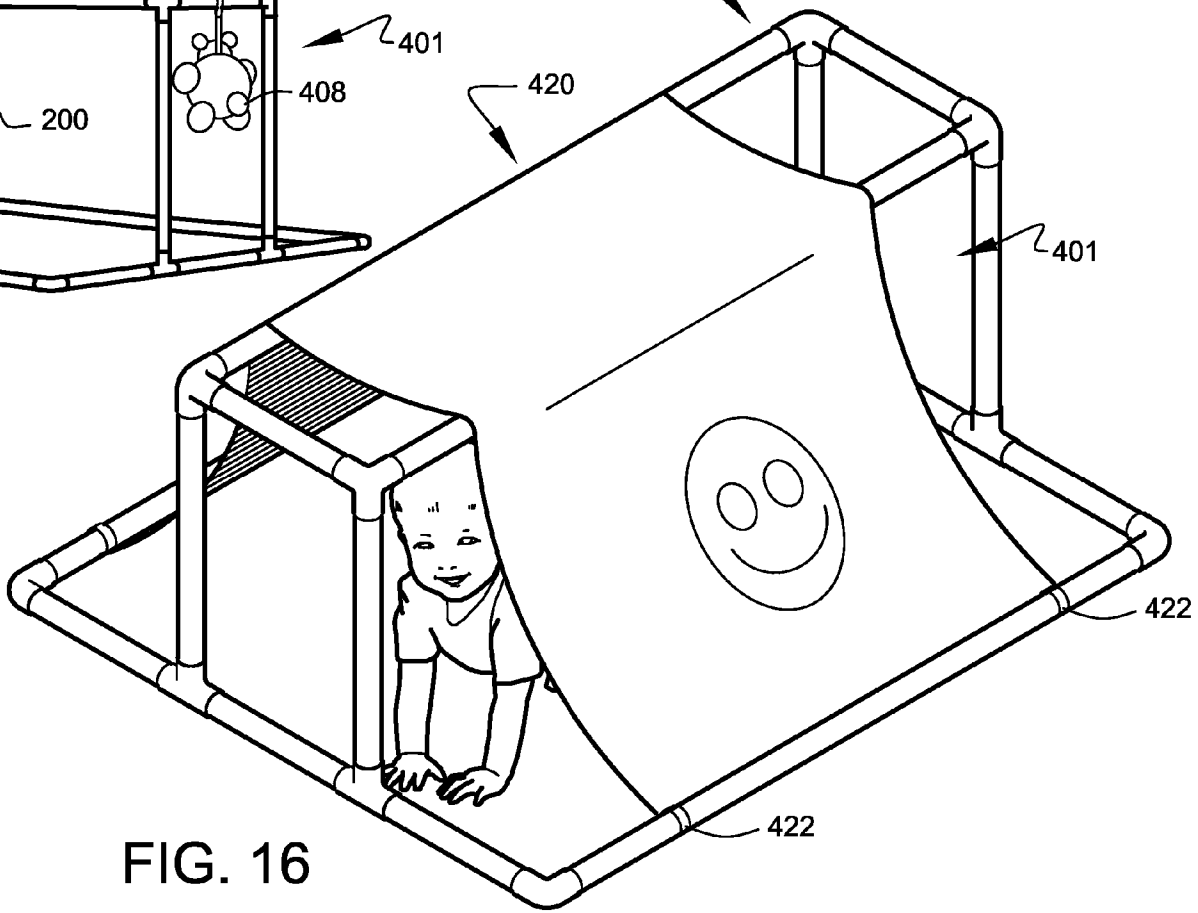
FIG. 16 shows a perspective view of another attachable play feature of the infant activity system kit of FIG. 8.

FIG. 16 shows a perspective view of another attachable play feature 401 of the infant activity system kit 200 of FIG. 8. Preferably, attachable play feature 401 of FIG. 15 comprises cover 420, as shown. Preferably, cover 420 is adapted to drape infant activity system 100 thus providing a "tent-like" structure for imagined play. Preferably, cover 420 comprises one or more hook-and-loop (or similar) fasteners 422 to assist in securing cover 420 to infant activity system 100, as shown.

Preferably, cover 420 (at least embodying herein at least one cover adapted to cover at least one portion of said infant activity system) is constructed from soft/flexible fabric materials, as shown. Upon reading the teachings of this specification, those with ordinary skill in the art will now understand that, under appropriate circumstances, considering issues such as intended use, etc., the inclusion of other cover features, such as, for example, themed indicia, storage pockets, windows, inflatable sections, soft padding including safety padding, etc., may suffice.

Figure 17:
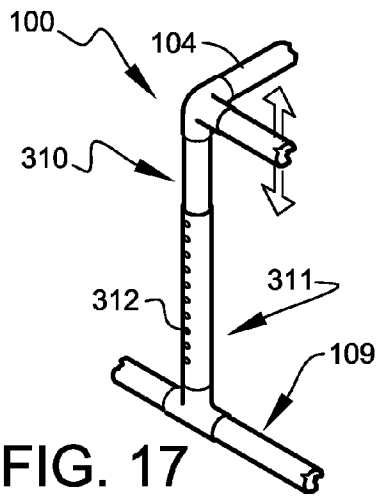
FIG. 17 shows a perspective view of a length adjustable attacher bar according to an alternate embodiment of the present invention.

FIG. 17 shows a perspective view of a length adjustable attacher bar 310, of infant activity system 100, according to an alternate preferred embodiment of the present invention. Alternate preferred embodiments of infant activity system 100 preferably comprise length-adjustable attacher bars 310 adapted to adjust the height (distance) of upper side bars 104 relative to the lower polygonal peripheral support 109, as shown (at least embodying herein wherein said at least one upper polygonal peripheral graspable bar is user adjustable to at least two fixed elevation positions relative to said at least one lower polygonal peripheral support). Preferably, the available adjustment is in the range of several inches. This preferred alternate feature allows the system to better accommodate older children. Preferably, length-adjustable attacher bars 310 comprise a telescoping sleeve arrangement having a locking mechanism 311, preferably comprising an interlocking "spring-button and hole" arrangement 312, as shown. Upon reading the teachings of this specification, those with ordinary skill in the art will now understand that, under appropriate circumstances, considering such issues as economics, user preference, ease of use, manufacturing preferences, etc., other leg height adjusting mechanisms, such as friction clamps, threaded locks, pins, screws, longer length support bars, etc. may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification.

Further, many other advantages of applicant's invention will be apparent to those skilled in the art from the above descriptions and the below claims.

What is claimed is:

1. An infant activity system, comprising:

an upper polygonal peripheral graspable bar comprising plastic piping, the plastic piping comprising a plurality of bars and connectors connected to form a polygon circumscribing an upper area;

a lower polygonal peripheral base comprising plastic piping, the plastic piping comprising a plurality of bars and connectors substantially forming a polygon and substantially enclosing a lower area, the lower area substantially enclosed by the lower polygonal peripheral base being greater than the upper area enclosed by the upper polygonal peripheral graspable bar; and a plurality of attacher bars comprising plastic piping, the attacher bars connecting the upper polygonal peripheral graspable bar and the lower polygonal peripheral base to support the upper polygonal peripheral graspable bar;

the infant activity system selectively configurable by hand without tools between a plurality of configurations, including a walking training configuration in which the upper polygonal peripheral graspable bar is oriented in a horizontal plane, the lower polygonal peripheral base is oriented in a horizontal plane resting on a surface, and the attacher bars are oriented vertically connecting the upper polygonal peripheral graspable bar and the lower polygonal peripheral base, a play feature configuration, and a storage configuration, in which the infant activity system is at least partially disassembled to take up less space; wherein configuring for the play feature configuration comprises one or more of removably mounting one or more play features to the infant activity system; and orienting the infant activity system such that the lower polygonal peripheral base and the upper polygonal peripheral graspable bar are oriented in vertical planes and at least two attacher bars of the plurality of attacher bars lie flush with the surface; wherein the one or more play features comprise at least one of a basketball hoop; a soft toy; a cover, the cover drapable over the upper polygonal graspable bar to form a tent-like structure; and a goal net.

2. The infant activity system of claim 1, wherein the basketball hoop comprises a u-shaped coupler, the coupler configured to rest on a horizontally oriented bar of one of the upper polygonal peripheral graspable bar and the lower polygonal peripheral base.

3. The infant activity system of claim 1, wherein the cover comprises one or more fasteners to secure the cover to the infant activity system to form a tent-like structure, the cover draped over the upper polygonal peripheral graspable bar with the fasteners attached to the lower polygonal peripheral base, the tent-like structure having walls that extend to the ground when the infant activity system is resting on the lower polygonal peripheral base.

4. The infant activity system of claim 1, wherein the connectors are concurrently friction-fittable to at least two bars.

5. The infant activity system of claim 1, wherein the connectors comprise one or more three-way elbow bar connectors.

6. The infant activity system of claim 1, wherein the plurality of bars and connectors of the upper polygonal peripheral graspable bar form a rectangle comprising two ends and two sides, the sides greater in length than the ends and the ends disposed at ends of the infant activity system and wherein the infant activity system is selectively rest-able on the lower polygonal peripheral base and the ends.

7. The infant activity system of claim 6, wherein the play feature configuration comprises orienting the infant activity system to rest stably and level on an end.

8. The infant activity system of claim 1, further comprising a container within which the infant activity system may be placed when the infant activity system is in a storage configuration.

9. The infant activity system of claim 8, wherein the container comprises a flexible bag.

10. The infant activity system of claim 1, wherein the walking training configuration further comprises a soft toy mounted on the upper polygonal peripheral graspable bar, such that the child may be placed opposite of the soft toy to motivate the child to walk toward the soft toy.

11. The infant activity system of claim 1, wherein the upper polygonal peripheral graspable bar and the lower polygonal peripheral base each have a length and a width, the length of the upper polygonal peripheral graspable bar substantially the same as the length of the lower polygonal peripheral base, and wherein the width of the lower polygonal peripheral base is at least three times the width of the upper polygonal peripheral graspable bar.

12. An infant activity system, comprising:

an upper polygonal peripheral graspable bar comprising plastic piping, the plastic piping comprising a plurality of bars and connectors connected to form a polygon circumscribing an upper area;

a lower peripheral base comprising plastic piping, the plastic piping comprising a plurality of bars and connectors connected to at least partially enclose a lower area, the lower area at least partially enclosed by the lower peripheral base being at least three times greater than the upper area enclosed by the upper polygonal peripheral graspable bar; and a plurality of attacher bars comprising plastic piping, the attacher bars connecting the upper polygonal peripheral graspable bar and the lower polygonal peripheral base to support the upper polygonal peripheral graspable bar;

the infant activity system selectively configurable by hand without tools between a plurality of configurations, including a walking training configuration, in which the upper polygonal peripheral graspable bar is oriented in a horizontal plane, the lower peripheral base is oriented in a horizontal plane resting on a surface, and the attacher bars are oriented vertically connecting the upper polygonal peripheral graspable bar and the lower peripheral base, a play feature configuration, and a storage configuration, in which the infant activity system is at least partially disassembled to take up less space; wherein configuring for the play feature configuration comprises one or more of removably mounting one or more play features to the infant activity system; and orienting the infant activity system such that the lower polygonal peripheral base and the upper polygonal peripheral graspable bar are oriented in vertical planes and at least two attacher bars of the plurality of attacher bars lie flush with the surface; wherein the one or more play features comprise at least one of a basketball hoop; a soft toy; a cover, the cover drapable over the upper polygonal graspable bar to form a tent-like structure; and a goal net.

13. An infant activity system, comprising:

an upper polygonal peripheral graspable bar comprising plastic piping, the plastic piping comprising a plurality of bars and connectors connected to form a rectangle circumscribing an upper area, the rectangle comprising two ends and two sides, the sides greater in length than the ends and the ends disposed at the ends of the infant activity system;

a lower polygonal peripheral base comprising plastic piping, the plastic piping comprising a plurality of bars and connectors connected to form a polygon substantially enclosing a lower area, the lower area substantially enclosed by the lower polygonal peripheral base being greater than the upper area enclosed by the upper polygonal peripheral graspable bar;

a plurality of attacher bars comprising plastic piping, the attacher bars connecting the upper polygonal peripheral graspable bar and the lower polygonal peripheral base;

one or more play features comprising one or more of a basketball hoop;

a soft toy;

a cover, the cover drapable over the upper polygonal graspable bar to form a tent-like structure; and a goal net;

a flexible bag container; and the infant activity system selectively configurable by hand without tools between a plurality of configurations, including a walking training configuration, in which the upper polygonal peripheral graspable bar is oriented in a horizontal plane, the lower polygonal peripheral base is oriented in a horizontal plane resting on a surface, and the attacher bars are oriented vertically supporting the upper polygonal peripheral graspable, a play feature configuration, wherein the play feature configuration comprises one or more of removably mounting one or more play features to the infant activity system; and orienting the infant activity system to rest on an end wherein the lower polygonal peripheral base and the upper polygonal peripheral graspable bar are oriented in vertical planes; and a storage configuration, in which the infant activity system is at least partially disassembled to take up less space.

* * * * *